US005147088A

United States Patent [19]

Smith et al.

[11] Patent Number: 5,147,088

[45] Date of Patent: Sep. 15, 1992

[54] MISSILE TRACKING SYSTEMS

[75] Inventors: James M. Smith; Peter W. Busby, both of Stevenage, United Kingdom

[73] Assignee: British Aerospace Public Limited Company, London, England

[21] Appl. No.: 41,124

[22] Filed: Apr. 16, 1987

[30] Foreign Application Priority Data

Apr. 29, 1986 [GB] United Kingdom ..... 8610507

[51] Int. Cl.[5] ..... F41G 7/00

[52] U.S. Cl. ..... 244/3.11

[58] Field of Search ..... 244/3.11

[56] References Cited

U.S. PATENT DOCUMENTS 4,003,659 1/1977 Conard et al. ..... 244/3.11

4,406,429 9/1983 Allen ..... 244/3.11

4,424,943 1/1984 Zwirn et al. ..... 244/3.11

FOREIGN PATENT DOCUMENTS 2083968 3/1982 United Kingdom .

2185166 7/1987 United Kingdom .

*Primary Examiner*—Charles T. Jordan

*Attorney, Agent, or Firm*—Nixon & Vanderhye

[57] ABSTRACT

A missile tracking system includes a target image sensor and a missile image sensor which record image data during respective target image exposure periods and missile image exposure periods. The missile is provided with an image enhancer such as a beacon or a corner reflector illuminated from the ground, which enhances the missile image only during the missile image exposure periods.

11 Claims, 2 Drawing Sheets

MISSILE TRACKING SYSTEMS

BACKGROUND OF THE INVENTION

This invention relates to missile tracking systems and in particular, but not exclusively to tracking systems which employ a solid state frame transfer charge coupled device image sensor (FTCCD).

A known form of such a system comprises a camera for forming an electrical video signal representative of a viewed scene containing a target and the flare of a missile being guided towards the target, the video signal being passed to electronic guidance apparatus which guides the missile within the field-of-view of the system, and also being passed to a display monitor so that an operator can maintain the system aimed at the target. The target itself and the viewed scene in general may be quite dull while the missile flare will usually be very bright. Also, the scene may contain some discrete fairly bright features, notably cloud edges and the like. In order to give the operator the best possible view of the target on the display monitor and to provide the best possible signal-to-noise ratio of the system in the face of the constant, ie sensitivity independent, base level of noise generated within the image sensor of the camera, the camera sensitivity is best adjusted to be as high as possible by reference to the general brightness of the viewed scene. However, because of the limited dynamic range of available image sensors, this will almost certainly mean that the missile flare image is well above the saturation limit of the camera so that, as far as the guidance apparatus is concerned, the apparent brightness of the aforementioned fairly bright scene features may approach or even equal that of the missile flare and hence may be confused with it.

The applicants have proposed in UK Patent Application No. 8431568, to which reference is directed, a system in which the sensitivity of an image sensor is controlled differently respectively during a first and a second plurality of fields alternately one with another.

The sensitivity during the respective periods may be respectively high and low so that, in effect, a greater dynamic intensity range of the sensor is obtained. In a missile guidance application the higher sensitivity portions are fed to a display to give an operator a good view of the target, whilst lower sensitivity portions are passed to a missile guidance unit so that this "sees" substantially only the missile flare and hence is not confused by cloud edges and the like.

The above system whilst possessing many advantages over the prior art is disadvantaged by the fact that the brightness of the missile flare may obscure the target when the missile is actually on the line of sight between the target and the tracker and moreover, during target tracking fields the sensitivity will be high and thus the image may spread.

SUMMARY OF THE INVENTION

According to this invention there is provided a tracking system including target image sensor means for imaging the viewed scene for a predetermined controllable first series of exposure periods at predetermined intervals, and for outputting data to enable the location of a target within the viewed scene to be determined, missile image sensor means for repetitively imaging the viewed scene for a predetermined controllable second series of exposure periods interspersed with said first series of exposure periods and for outputting data to enable the location of a missile within the viewed scene to be determined, and means for enhancing the image of the missile or a part thereof only during at least part of each exposure period of said second series of exposure periods.

Preferably, said target image sensor means and said missile image sensor means comprise a single charged-coupled device which is controlled to output alternate T.V. field frames having sensitivities adjusted for the target tracking and the missile tracking respectively. An example of such a device is described in co-pending UK application No. 8431568.

Said means for enhancing the image of the missile in one embodiment comprises a missile beacon that may be switched on and off in synchronism with the missile tracking fields of the image sensor. Such a beacon may, for example, be an electric gas discharge lamp, a pulsed laser or a series of magnesium flash lamps.

Alternatively said means may incorporate a ground based laser beam which is directed towards said missile and reflected by reflecting means carried by said missile, for example a corner reflector.

DESCRIPTION OF FIGURES

Further aspects will become apparent from the following description which is by way of example only, reference being made to the accompanying drawings in which.

DESCRIPTION OF PREFERRED EMBODIMENT

Figure 1:
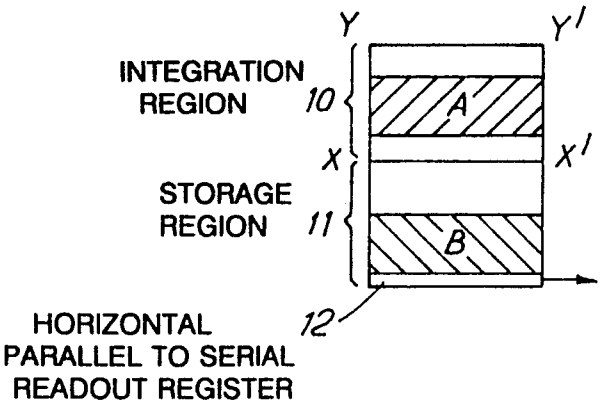
FIG. 1 is a schematic view illustrating a frame transfer charge coupled device operating in a partial readout mode.

Referring initially to FIG. 1, there is illustrated a CCD sensor comprising an imaging area or integration region 10 a storage region 11, and a horizontal parallel to serial readout register 12 for supplying an electrical video output signal. The design of such sensors is well known to those skilled in the art and well documented; the construction of the sensor will not therefore be described in detail.

The technique of partial read out will now be described. The shaded band in FIG. 1 shows a selected part of the imaging area 10 at A; this is transferred to B in the storage region 11 for readout at normal line frequencies. This is achieved by simply alerting the number of transfer clock pulses. Charge from the unwanted part of the image (i.e. that part of the image excluding area A) is simply dumped into the horizontal readout register 12 which generally has sufficient capacity to sweep it away. For devices with an anti-blooming structure extending throughout the charge integration region, unwanted charge may be shed at the interface XX'. The image area could be reduced in size by loading multiple lines into the horizontal output register 12. Thus, for example, the field rate would be doubled if lines were transferred into the output register two at a time. In this case vertical resolution would be sacrificed instead of there being loss of image area.

The photo-charge accumulation during each partial field is inhibited by a variable amount using the purging technique described in UK Patent No. 2083968. This method provides exposure control by removing image charge from the integration region 10 for a variable portion of the video field by reverse clocking the transfer registers into a drain diffusion along the edge of the device (not shown in the present device). Alternatively, for devices as those illustrated with an anti-blooming structure (not shown), the charge may be purged by clocking against a barrier causing the unwanted charge to overflow into the excess charge dispersion drains. Either reverse clocking towards the channel end stop YY' or forward clocking against the confining barrier XX' of a static storage register are suitable for purging image charge from devices with an anti-blooming structure. The design and construction of anti-blooming structures is well documented and will not be described in detail.

UK Patent Application Application No. 8431568 discloses a method of the sensitivity control of alternate TV fields which provides two separate outputs; one optimised for target tracking, and the other optimised for missile tracking.

The method uses dual exposure control loops to optimise the exposure period in alternating partial fields in a combined missile and target tracker. The tracker forms part of the guidance loop of a guided weapon. The first partial field is optimised to provide a correctly exposed image of a target such as an aircraft. The following partial field has the exposure optimised for tracking a missile which carries a beacon in the form of a pyrotechnic flare or electric lamp. The positions of the target and missile in the camera field of view can be compared to provide correction signals to the missile and guide it to intercept the target. Typically, the partial fields optimised for missile beacon tracking will be less sensitive than the target tracking fields thus preventing the missile tracker from being decoyed by extraneous bright points in the scene. The advantage gained by this dual tracker over trackers using two separate cameras for missile and target tracking is complete absence of collimation errors between the trackers.

In the present invention, however, the image of the missile is enhanced only during the partial view of the missile tracking. In one embodiment, the missile includes a dual tracking system as previously described but with the addition of a missile beacon that may be switched on and off in synchronism with the missile tracking fields of the ground based tracker. Such a beacon may, for example, be an electric gas discharge lamp, a pulsed laser or a series of magnesium flash lamps. Control means are associated with the missile which cause the beacon to flash in synchronism with the missile tracking field of the tracker.

A second embodiment of this invention incorporates a ground based laser beam which is directed towards the missile from the missile tracker and reflected back to the aforesaid tracker by means of a corner reflector or other reflecting means carried on board the missile. Again, the laser will be caused to illuminate the reflector only during the missile tracking fields.

Figure 2:
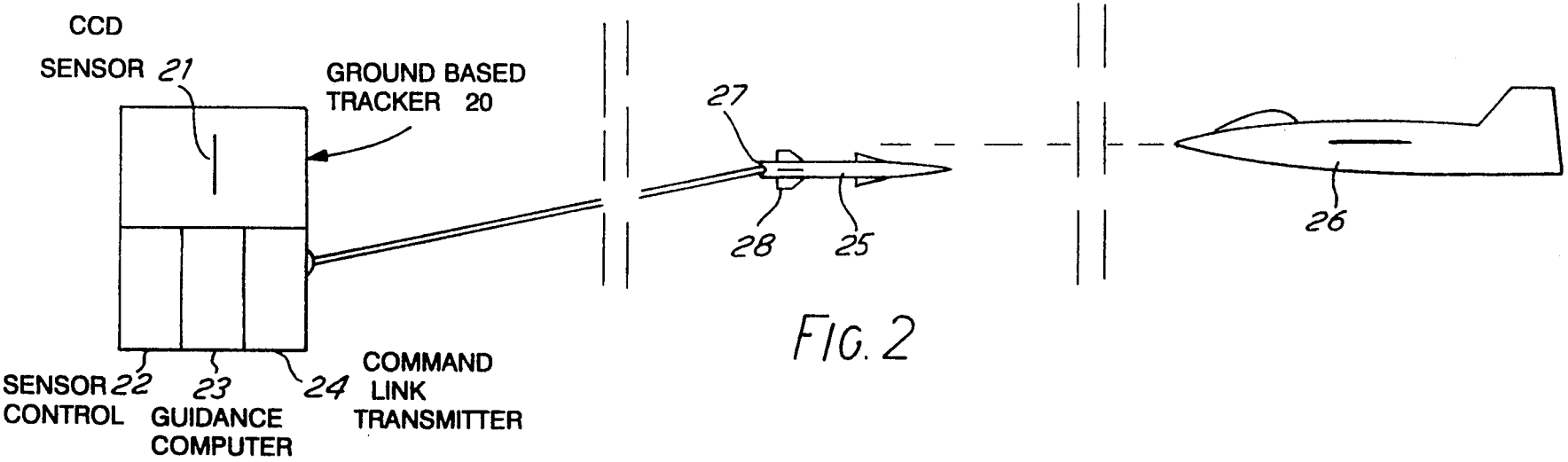
FIG. 2 is a schematic representation of an embodiment of tracking system according to the invention.

Referring to FIG. 2 the tracker system comprises a ground based tracker 20 including a CCD sensor 21, a sensor control 22 for controlling operation of the sensor and synchronising its operation with the other parts of the system, a guidance computer 23, a command link transmitter 24 for transmitting guidance commands to guide the missile 25 to intercept the target 26. The missile 25 includes an image enhancer 27 and a command link receiver 28.

In operation the CCD sensor 21 is operated to output alternate T.V. fields optimised to the target and the missile respectively and the image enhancer is operated so that the image is enhanced only when the sensor is imaging the missile.

In a first embodiment the image enhancer is a pulsed beacon synchronised with the imaging of the missile which is turned on during the periods when the camera is integrating missile tracking fields and turned off when the camera is integrating target tracking fields. In a second embodiment the image enhancer comprises a corner reflector illuminated by a ground based beam pulsed as before.

In this second embodiment the laser beam is directed from the tracker to the missile and reflected back to the tracking camera by means of reflecting means carried onboard the missile. The laser beam is turned on during the missile tracking fields and turned exclusively off during the target tracking fields but additionally may incorporate a coded sequence of on/off pulses that will form the command link to the guided missile by means of suitable detectors mounted on the missile as well as the reflectors. The command sequence will be operated during the missile tracking field and will be detected by a suitable receiver on board the missile.

The following attributes of this invention will be applicable to both a missile borne beacon tracker and a reflected laser beam tracker. For brevity, the term beacon will imply reflected laser beam for the second embodiment.

The preferred design of the beacon will provide a large amount of energy in a short period. The field exposure period of the FTCCD will also be of short duration when tracking the missile beacon. In this manner, background reflected sky radiation collected by the imager will be minimised and a beacon image of high contrast against the background obtained. Typically, the FTCCD exposure period will be less than 1.0 ms for missile tracking.

A major advantage arising from the described arrangement is a complete absence of missile beacon obscuration during the target tracking video fields. In trackers with continuously running beacons or non-synchronised pulsed beacons the image spread from the bright missile beacon effectively obscures the target as the missile travels along the line of sight between the tracker and the target.

Without missile beacon obscuration of the target, it is a relatively simple task to automatically track both missile and target, obviating the need to stabilise the sightline as a reference datum for the missile tracker and the improved tracking accuracy and a simple missile guidance trajectory allow greater interception probability. Provided the target image is held within the central portion of the camera field of view, the missile tracker will reference to a moving datum provided by the target autotracker, corresponding to the desired interception point of the target. This enables a simple form of automatic target tracking to be employed with a high degree of reliability. This in turn will allow the target sight line (along which the missile is guided) to move in the field of view of the camera reducing the amount of stabilisation required.

A third important attribute is a high degree of immunity from countermeasures and non-intentional decoying light sources thus obviating the need for gating techniques around the target. Countermeasures are generally bright light sources carried or dropped from the target with the purpose of decoying the missile beacon tracker. A decoy source will either be continuously emitting, such as a pyrotechnic flare, or pulsed on and off out of synchronism with the missile tracker. They will thus be seen in both the missile and target tracking fields and can thus be discounted. Alternatively, the missile beacon could be identified by switching it off for a single tracking field. An extremely high degree of immunity would be afforded by emitting two closely spaced beacon pulses and moving the charge coupled image plane between reception of the first and second pulse. The double pulse would then be identified as two images separated by a known distance dictated by the time interval of the beacon pulses and the velocity of movement of the image plane.

A fourth advantage to be gained from a pulsed beacon is a complete absence of image transfer smear. If a beacon image is continuously present when the image charge is transferred from the integration to the storage region, then a smearing will occur as the moving charge sites pass through the beacon image. For a very bright beacon image, the amplitude of this smeared image may result in a saturated smear running from the top to bottom of the TV picture field, resulting in the loss of positional information in one axis. Switching off the beacon prior to image transfer eliminates this problem For frame transfer CCD's with an anti-blooming structure, a fifth advantage is accrued; a short missile tracking exposure allows a corresponding larger target tracking exposure period giving improved sensitivity for operation under low light level conditions and making all the significant TV field period available for target tracking. The sequence of operation is depicted in FIG. 3 for a target image exposure period variable between 0.2 ms and 19.8 ms and a beacon flashing for a period of less than 0.2 ms at intervals of 20 ms. It should be noted that for simplicity, the frame transfer times between the integration and storage regions have been omitted; they are normally less than 0.2 ms.

Figure 3A:
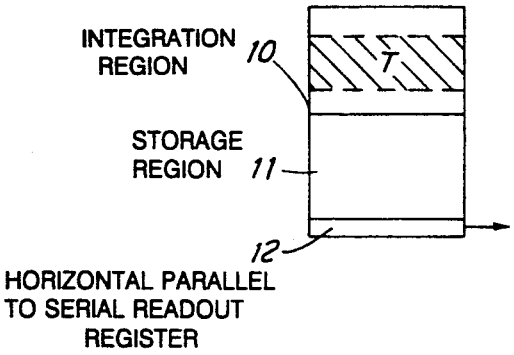
FIGS. 3*a* to 3*e* illustrate sequential steps in the operation of a CCD sensor in a tracking system.
Figure 3B:
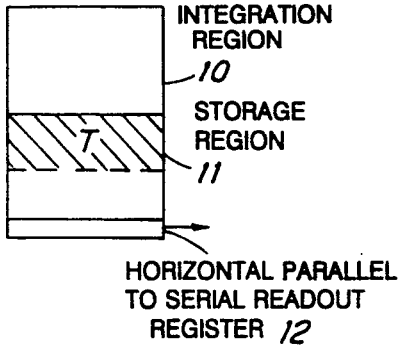
Figure 3C:
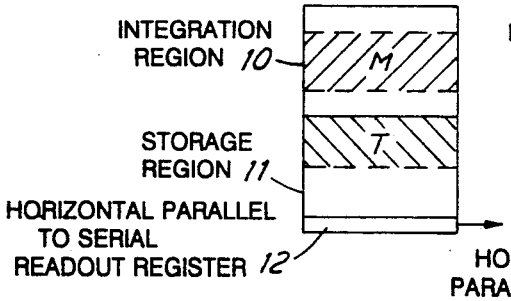
Figure 3D:
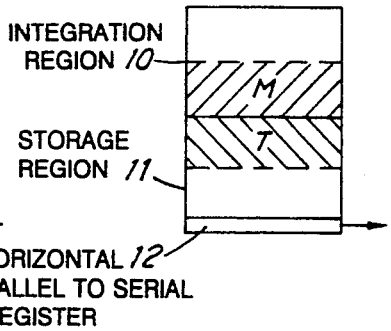
Figure 3E:
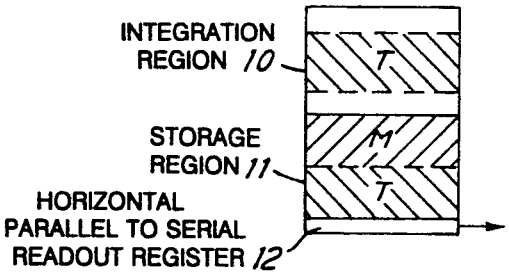

Referring to FIG. 3*a*, during the target exposure period the image is integrated for a period variable between 0.2 and 19.8 ms using a forward or reverse clocking technique to dump charge. In FIG. 3*b* the target information is transferred to the storage area. During the missile exposure period (FIG. 3*c*) the image is integrated for a period of 0.2 ms and the beacon, or the laser as the case may be, is commanded to flash on. Unwanted charge intermediate the partial field marked "M" and the storage region is shed (FIG. 3*d*) by operating the charge moving mechanism in the integration region whilst the charge remains stationary in the storage region. A barrier is created at the interface between the regions when no storage wells are created for charge moving out of the integration region and charge overflows into the anti-blooming structure. In FIG. 3*e*, the missile beacon tracking information has been transferred into the storage region. Both target and missile positional data are read out whilst the next target exposure is being integrated.

A sixth advantage for this type of tracker is the ability of allowing two or more missiles to intercept two or more targets simultaneously in the same engagement. In this case the partial readout technique is configured to read out three or more partial fields during a conventional TV field. In a typical case, a target tracking field using half the image area for an integration period of up to half the normal field period (10 ms) would be used to track all the targets. The missile tracking fields would be subdivided to allow two or more to be read out during the remaining half field period.

Beacons on each missile will be commanded to flash only during the relevant integration period. This sixth advantage is not likely to be applicable to the second embodiment as it would not be possible to discriminate between two missiles unless a means were incorporated for disabling one of the corner reflectors.

Furthermore, in the second embodiment, the absence of a missile borne beacon allows a cheaper, more reliable round to be manufactured. In both embodiments missile positional errors can be detected with a minimal delay allowing prompt correction commands to be transmitted.

The described arrangement thus provides a dual tracker for a missile and target which incorporates a solid state charge coupled imaging device (CCD) which enables the missile to be guided to intercept the target. The tracker operates according to television principles but with sequential partial TV fields operating as missile tracker and target tracker.

What is claimed is:

1. A tracking system including target image sensor means for imaging the viewed scene for a predetermined controllable first series of exposure periods at predetermined intervals, and for outputting data to enable the location of a target within the viewed scene to be determined, missile image sensor means for repetitively imaging the viewed scene for a predetermined controllable second series of exposure periods interspersed with said first series of exposure periods and for outputting data to enable the location of a missile within the viewed scene to be determined, and means for enhancing the image of the missile or a part thereof only during at least part of each exposure period of said second series of exposure periods.

2. A tracking system according to claim 1, wherein said target image sensor means and said missile image sensor means comprise a single charge-coupled device controlled to output alternate TV field fames having sensitivities adjusted for target tracking and missile tracking respectively.

3. A tracking system according to claim 1, wherein said means for enhancing the image of the missile comprises a missile beacon switched on during each missile tracking field of the image sensor.

4. A tracking system according to claim 3, wherein said beacon comprises an electric gas discharge lamp.

5. A tracking system according to claim 3, wherein said beacon comprises a pulsed laser.

6. A tracking system according to claim 3, wherein said beacon comprises a series of magnesium flash lamps.

7. A tracking system according to claim 1, wherein said means for enhancing the image of the missile includes a reflector associated with said missile and a ground-based laser arranged to illuminate said reflector.

8. A tracking system according to claim 7, wherein said reflector comprises a corner reflector.

9. A tracking system according to claim 7, wherein said laser is adapted to emit a pulse-coded beam during said missile tracking field, said pulse-coded beam containing command data for reception by a command link receiver associated with said missile.

10. A tracking system according to claim 1, wherein said means for enhancing said missile image includes means associated with said missile for emitting closely spaced beacon pulses, means associated with said missile image sensor means for moving the image plane between the first and second pulse, and means for determining the separation between the image of said first pulse and the image of said second pulse.

11. A tracking system according to claim 2, wherein said charge coupled device is operated to provide at least three partial fields during a TV field frame period, one of said partial fields being arranged to provide positional information of a target, another of said partial fields being arranged to provide positional information of a first missile, a yet further partial field being arranged to provide position information of a second missile, means associated with said first missile to enhance its image only during the exposure periods corresponding to said further partial field and means associated with said second missile to enhance its image only during the exposure periods corresponding to said yet further partial field.

* * * * *